United States Patent [19]

Neuner et al.

[11] 4,329,068

[45] May 11, 1982

[54] MIXING MACHINE

[76] Inventors: Terry E. Neuner, 504 Westmount Ave., Columbia, Mo. 65201; Michael E. Gresham, Rte. 5, Box 360, Fulton, Mo. 65251

[21] Appl. No.: 142,401

[22] Filed: Apr. 21, 1980

[51] Int. Cl.[3] ..... B01F 11/00

[52] U.S. Cl. ..... 366/214; 366/235; 366/601

[58] Field of Search ..... 366/213, 214, 217, 220, 366/232, 236, 601, 605, 53, 54, 60, 142, 185, 204, 347, 235

[56] References Cited

U.S. PATENT DOCUMENTS

| | | | |
|---|---|---|---|
| 493,046 | 3/1893 | Shumway | 366/214 |
| 1,336,862 | 4/1920 | Royan | 366/185 |
| 2,345,130 | 3/1944 | Latham . | |
| 2,411,174 | 11/1946 | Swenson et al. . | |
| 2,662,752 | 12/1953 | Miller et al. | 366/214 |
| 2,736,288 | 2/1956 | Clay et al. | 366/220 |
| 3,163,404 | 12/1965 | Kraft et al. . | |
| 3,194,542 | 7/1965 | Pfeifer . | |
| 3,231,244 | 1/1966 | Moody et al. . | |
| 4,162,856 | 7/1979 | Bassett et al. . | |

FOREIGN PATENT DOCUMENTS

| | | |
|---|---|---|
| 963775 | 1/1950 | France . |

*Primary Examiner*—Philip R. Coe
*Assistant Examiner*—Timothy F. Simone
*Attorney, Agent, or Firm*—Lowe, Kokjer, Kircher, Wharton & Bowman

[57] ABSTRACT

A mixing machine for tumbling a rack which carries a plurality of volumetric glassware tubes containing chemical solutions. The machine includes a stand which rotatively supports a tumbler box adapted to closely receive the rack. The tumbler box includes a floor and a lid which engage the ends of the volumetric tubes to prevent them from shifting in the tumbler box and to hold rubber stoppers in place in the tubes. The tumbler box is rotated by an electric motor having a timing switch and a cam switch that stops the box in an upright position.

6 Claims, 5 Drawing Figures

MIXING MACHINE

BACKGROUND AND SUMMARY OF THE INVENTION

This invention relates in general to the mixing of chemical solutions and deals more particularly with a tumbling machine which is used to simultaneously mix the contents of a plurality of glassware containers.

Various types of chemical solutions must be throughly mixed in order to permit analysis of the contents. For example, devices known as block digesters are used in analyzing feed samples and fertilizer samples which are reacted and mixed in volumetric glassware tubes with chemicals such as sulphuric acid solutions and then brought to a specific volume. The volumetric tubes are held in the block digester in a rack which typically supports 20 or 40 individual tubes. After the racks are removed from the block digester, the chemical solutions in the tubes must be throughly mixed so that the chemical analysis can proceed.

At present, mixing of the solutions is normally carried out manually by shaking each individual volumetric tube in the hand. As can easily be appreciated, this manual mixing operation is an unpleasant task which takes considerable time and effort on the part of laboratory technicians. Also, because the solutions usually contain acids and other volatile substances, the workers are exposed to the possibility of chemical burns. It has been found that a relatively slow rate of rotation of the tubes on the order of six revolutions per minute results in the most effective mixing for the types of solutions which are contained in block digestion tubes. The slow rate of rotation effects thorough mixing primarily because air bubbles in the tubes can then reciprocate the full length of the tube to facilitate mixing of dense substances with lighter substances. It is difficult at best to achieve such a slow rate of rotation manually, and even if it is achieved, the valuable time of laboratory technicians is consumed. A further drawback in connection with the manual mixing operation is that it cannot be accurately timed to continue for the proper length of time. If the solutions are mixed for too short a period, they are not mixed throughly enough and if they are mixed too long, time is wasted needlessly and the chemical analysis is delayed.

The present invention is aimed at eliminating these problems and has, as its principal object, the provision of a mixing machine for automatically mixing various types of chemical solutions contained in volumetric glassware containers. The automatic operation of the machine is of particular importance because it permits the contents of the containers to be mixed unattended, thus freeing the laboratory technicians for more productive work during the mixing operation. Additionally, the unpleasant task of manually mixing the tubes is eliminated.

Another important object of the invention is to provide a mixing machine of the character described which orients each of the volumetric tubes in an upright position after completion of the mixing operation.

A further object of the invention is to provide a mixing machine of the character described which tumbles the volumetric tubes at a constant rotational speed which is relatively slow in order to effectively mix the solutions contained in the tubes.

Still another object of the invention is to provide a mixing machine of the character described in which the mixing time can be accurately preset and can be adjusted as desired throughout a wide range.

An additional object of the invention is to provide a mixing machine of the character described wherein leakage from the glassware tubes is prevented and the tubes are held against shifting movement in the tumbler. The tumbler is constructed to hold the glassware tubes firmly between the lid and floor with the lid of the tumbler bearing against stoppers which are fitted in the tubes to seal their open top ends against leakage.

Yet another object of the invention is to provide a mixing machine of the character described which is well adapted to accomodate glassware tubes of various sizes and styles and various types of racks.

A still further object of the invention is to provide a mixing machine of the character described which is simple and economical to construct and safe and reliable in operation.

Other and further objects of the invention, together with the features of novelty appurtenant thereto, will appear in the course of the following description.

DETAILED DESCRIPTION OF THE INVENTION

In the accompanying drawings which form a part of the specification and are to be read in conjunction therewith and in which like reference numerals are used to indicate like parts in the various views.

Figure 1:
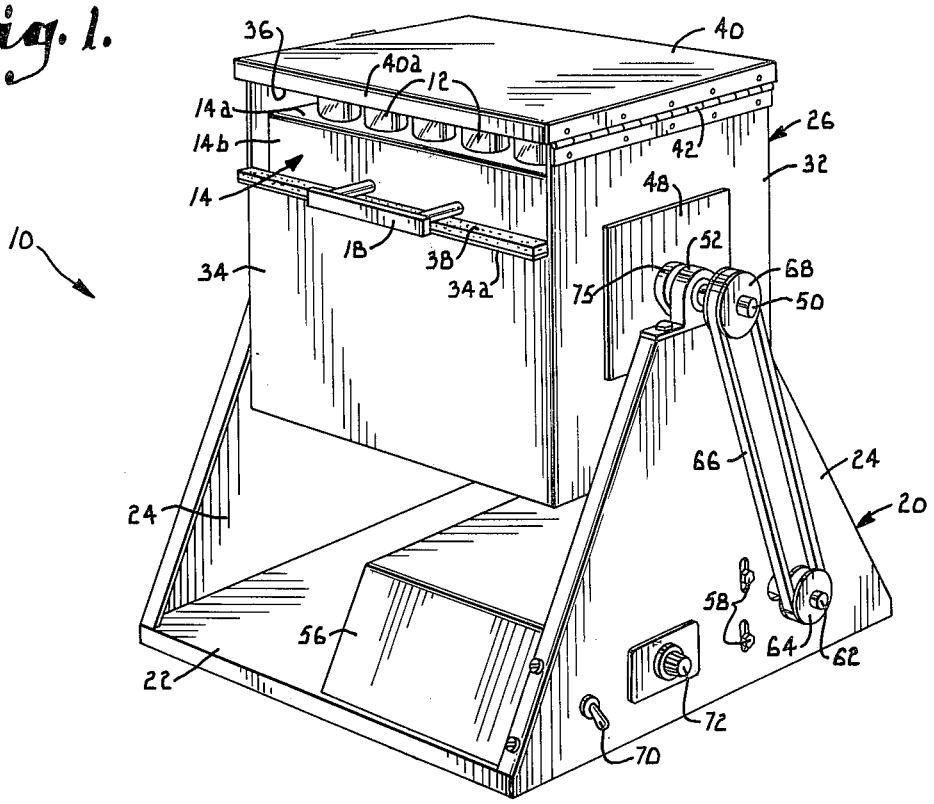
FIG. 1 is a perspective view of a mixing machine constructed according to a preferred embodiment of the invention.

Referring now to the drawings in detail, numeral 10 generally designates a mixing machine which is used to mix chemical solutions contained in a plurality of glass tubes 12. The tubes 12 are volumetric tubes which may be of the type used in a block digester device (not shown). The tubes contain chemical solutions such as a feed sample or fertilizer samples which have been reacted with chemicals such as boiling sulfuric acid and mixed with water in order to permit chemical analysis of the contents of the sample. The tubes 12 are held in the block digester device in a rack 14.

Figure 4:
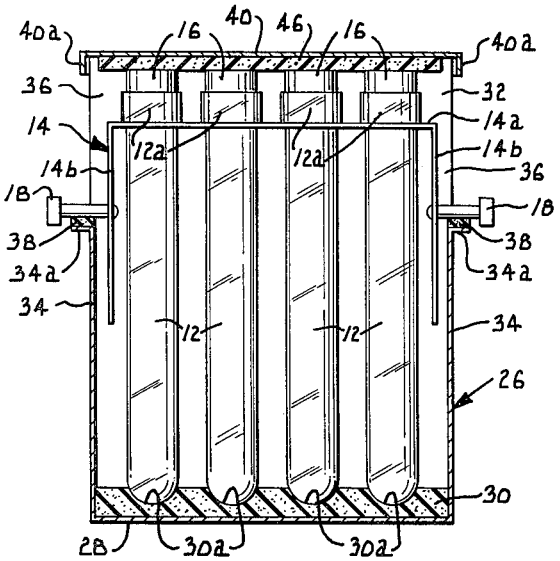
FIG. 4 is a fragmentary sectional view taken generally along line 4—4 of FIG. 2 in the direction of the arrows.

As best shown in FIG. 4, rack 14 includes a flat top panel **14*a* having a series of openings through which tubes 12 extend. Each tube 12 has an enlarged collar 12*a* at its upper end which is larger than the corresponding opening in panel 14*a* such that it rests on top of the panel to support the tube on rack 14. Each tube 12 has a closed, rounded bottom and an open top end which closely receives a conventional rubber stopper 16 in order to prevent leakage of the solution out of the tube. It is contemplated that the stoppers 16 may in some cases be eliminated. The rack 14 includes opposite side panels 14*b* having outwardly projecting handles 18** which facilitate handling of the rack and the tubes supported thereon. Each tube 12 has a height greater than that of the side panels 14*b*.

The frame of the mixing machine 10 includes a stand which is generally designated by reference numeral 20. The stand has a flat base portion 22 which is adapted to rest on a counter top or table in a stable manner. Opposite sides 24 of the the stand extend upwardly from base 22 and are generally triangular.

A rectangular tumbler box 26 is mounted on stand 20 for rotation about a generally horizontal axis. Tumbler box 26 includes a flat bottom panel 28 which receives a removable pad 30 forming the floor of the tumbler. The pad 30 is preferably constructed of a compressible material such as neoprene rubber having curved indentations 30*a* in its upper surface in order to receive the rounded lower ends of tubes 12. Pad 30 may be removed from tumbler box 26 and replaced by a mat having a different thickness in order to accomodate tubes of various heights. Tumbler box 26 includes a pair of end panels 32 and a pair of opposite side panels 34 which terminate below the top end of the tumbler in order to provide openings 36 through which the rack handles 18 extend. A flange 34*a* is turned outwardly from the upper edge of each side panel 34, and a rubber strip 38 is mounted on top of each flange 34*a* in order to receive the corresponding handle 18 thereon. The strips 38 serve to cushion the contact of handles 18 with the tumbler.

Figure 2:
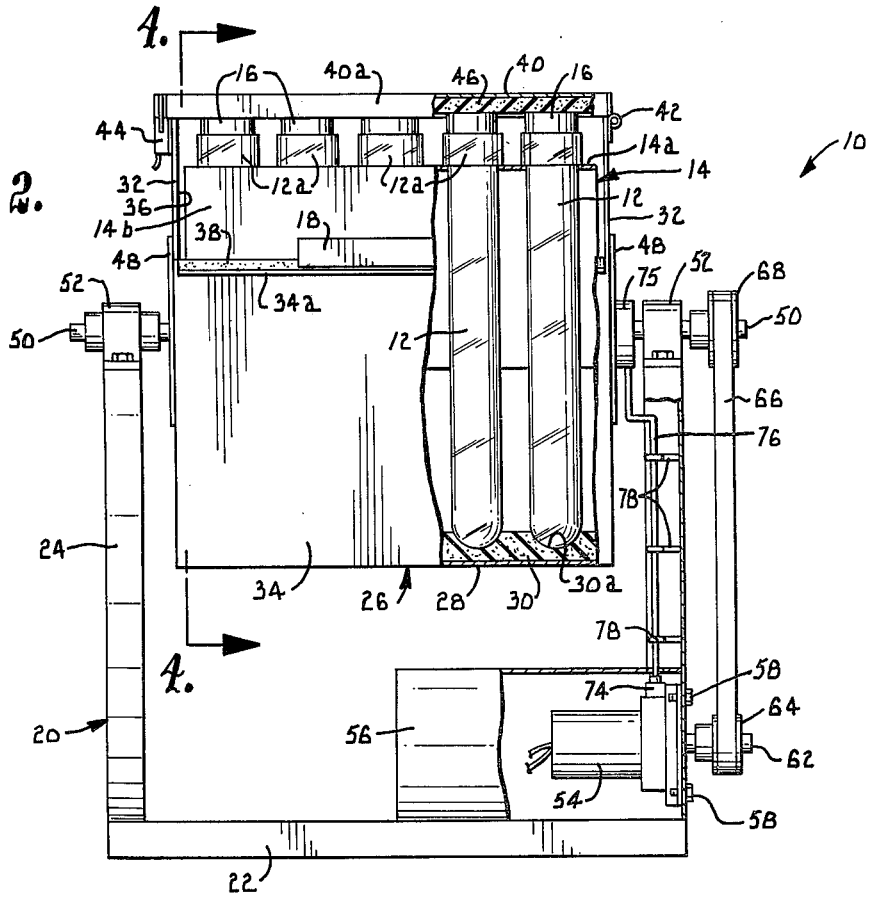
FIG. 2 is a front elevational view of the mixing machine shown in FIG. 1, with portions broken away for purposes of illustration.
Figure 3:
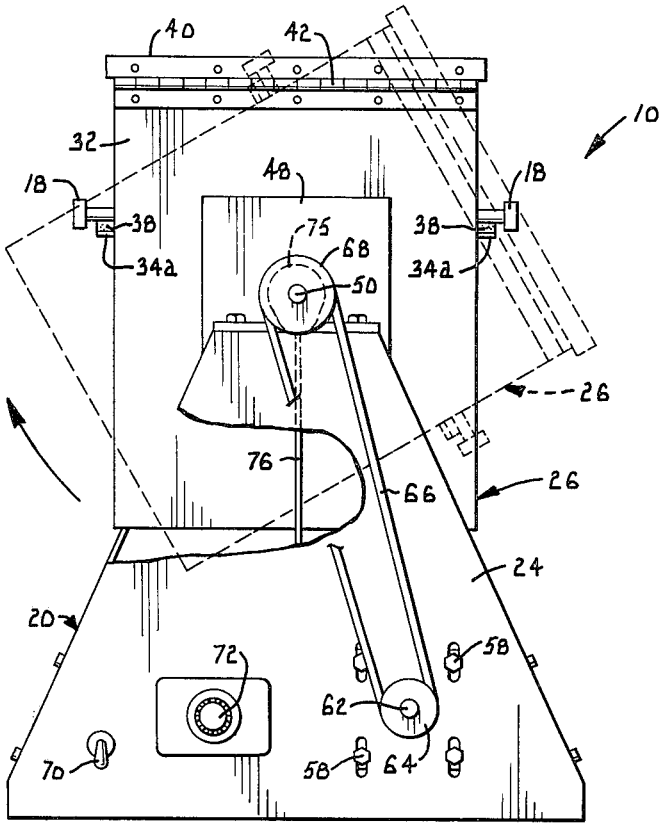
FIG. 3 is a side elevational view of the mixing machine, with portions broken away for purposes of illustration and the broken lines indicating rotation of the tumbler to an inclined position.

Tumbler box 26 is equipped with a lid 40 which is connected at one edge with one of the end panels 32 by a piano-type hinge 42. Lid 40 can be opened about hinge 42 in order to permit entry of rack 14 and tubes 12 into tumbler box 26, and the lid can be closed as shown in FIG. 2. A clasp type latch 44 serves to securely hold lid 40 in the closed position. The lid includes down turned flanges 40*a* on each of its edges.

The underside of lid 40 carries a compressible pad 46 which may be formed of any suitable material such as neoprene rubber. Compressible pad 46, when constructed of a closed cell type of rubber or lined with a flexible closed cell plastic, can fit directly against the tops of tubes 12 to prevent leakage. Stoppers are used to prevent leaks on all tubes 12, for convenience or if any of the tops of tubes 12 are chipped or broken. When the lid is closed, pad 46 bears against the top surfaces of stoppers 16 (or tubes 12) in order to secure the stoppers and tubes in place sealing the open top ends of tubes 12. Each tube 12 is tightly held between the pads 30 and 46, while rack 14 prevents the tubes from shifting laterally in the tumbler. The enlarged collars 12*a* of the tubes bear downwardly on top panel 14*a* of the rack, and handles 18 bear against the strips 38.

The opposite end panels 32 of tumbler box 26 carry flat plates 48 from which shafts 50 extend outwardly from the tumbler. Each shaft 50 is received for rotation in a bearing 52 which is mounted on top of side 24 of stand 20. Shafts 50 are coaxial and are oriented horizontally in order to mount tumbler box 26 on stand 20 for rotation about the horizontal axis defined by the shafts.

Tumbler box 26 is driven rotatively by a conventional electric motor 54 which is mounted within a hollow compartment 56 formed on top of base 22 of the stand. Motor 54 is mounted to the inside surface of one of the sides 24 by adjustable bolts 58. The motor is preferably a gear reduction motor of the brake type having an output shaft 62 which is braked by the motor immediately upon deenergization thereof. The output shaft 62 of the motor carries a pulley 64 which receives a drive belt 66. Belt 66 is also drawn around a pulley 68 which is mounted on one of the shafts 50 extending from tumbler box 26. A guard (not shown) is preferably mounted around the drive belt 66 and pulleys 64 and 68.

The operation of motor 54 is controlled by a series of switches, including a main power switch 70 which is an on-off type switch mounted on one side 24 of the stand. A timing switch 72 is likewise mounted on panel 24 and includes a rotary dial operated by a timer. The dial can be turned in order to set a preselected time of operation of the motor after which the motor deenergizes. A third switch 74 is a plunger type switch mounted within the motor housing 56. Switch 74 is controlled by a cam 75 which is carried on tumbler box 26 for rotation therewith. Cam 75 rotates with shaft 50 and is eccentric relative thereto, having a large lobe which is oriented to project downwardly when box 26 is in the upright position of FIG. 2. In this position, the lobe of the cam contacts the top end of a push rod 76 which is mounted for vertical sliding movement relative to the frame. Supports 78 are secured to side 24 of the stand and have looped portions which receive push rod 76. When the top end of rod 76 is engaged by the large lobe of cam 75, the rod is pushed downwardly to depress the plunger of switch 74, thereby opening the switch. When box 26 is rotated to rotate the large lobe of the cam away from rod 76, the rod is released and the plunger of switch 74 extends to close switch 74. Switch 74 is thus open whenever tumbler box 26 is oriented such that tubes 12 are in upright positions and is closed at all other times.

Figure 5:
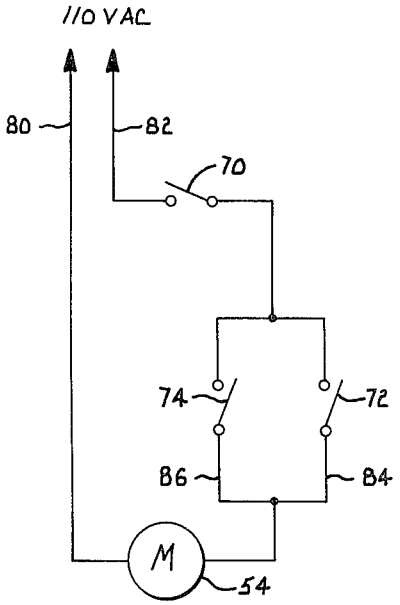
FIG. 5 is a schematic diagram of the electrical control system which controls the drive motor the machine.

Referring now to FIG. 5, the electric circuit which controls the operation of motor 54 includes a pair of conductors 80 and 82 which may be connected to a power source such as a wall outlet. Line 80 leads to motor 54, while the main switch 70 is included in line 82. A pair of conductors 84 and 86 extend between lines 80 and 82 in parallel to one another. The timing switch 72 is included in line 84, and the normally closed plunger switch 74 is included in line 86. When the main switch 70 is closed, motor 54 is energized whenever either one of the switches 72 or 74 is closed to complete the control circuit.

In operation, the lid 40 of tumbler 26 is swung upwardly about hinge 42 to the open position, and rack 14 and tubes 12 are inserted in the tumbler with the tubes in an upright position. Lid 40 is then closed and locked in the closed position by latch 44, and the dial associated with the timing switch is set to close switch 72 for the desired time period during which mixing of the contents of the tubes is to occur. When the main switch 70 is subsequently closed, motor 54 is energized to effect rotation of tumbler box 26 relative to stand 20. Motor 54 is preferably a gear reduction motor providing 60 inch-pounds of torque and driving its output shaft 62 at a speed to rotate tumbler 26 at approximately 6 revolutions per minute. This relatively slow rotational speed effects thorough mixing of the solutions in tubes 12, primarily because it permits air bubbles to reciprocate from end to end within the tubes to thereby mix the dense material with the lighter materials.

During rotation of the tumbler, tubes 12 are held tightly between pads 30 and 46 and are thus prevented from shifting or leaking within the tumbler. In addition, pad 46 maintains the rubber stoppers 16 tightly in place in the top ends of tubes 12 to prevent leakage of the contents as the tubes are tumbled. After motor 54 has been energized, the machine operates unattended, and the laboratory technician can tend to other matters while the machine operates.

So long as the timing switch 72 remains closed, the circuit to motor 54 remains completed, and the position of switch 74 has no effect on the motor. However, once the time interval which is preset on the dial associated with switch 72 elapses, switch 72 opens and the motor remains energized only so long as switch 74 remains closed. Thus, if tumbler box 26 is at other than an upright position when the preset time period elapses, motor 54 remains energized until the tumbler reaches an upright position, at which time cam 75 acts against push rod 76 to depress the plunger associated with switch 74 in order to open the switch. Motor 54 is then deenergized and provides braking action which stops the tumbler box in the upright position so that all of the tubes 12 are oriented in upright positions. After completion of the tumbling operation, switch 70 is moved to the open or off position, and lid 40 is opened to permit removal of the rack and tubes. Another rack containing volumetric glassware tubes may then be inserted in the tumbler for mixing in the same manner.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described our invention, we claim:

1. A machine for mixing chemical solutions contained in a plurality of glassware containers, said machine comprising:

a rack structure adapted to hold the containers in upright positions in spaced apart relation to one another;

a frame adapted to rest on a support surface;

a tumbler mounted on said frame for rotation about a substantially horizontal rotational axis, said tumbler being adapted to closely receive said rack structure;

power means for driving said tumbler about said rotational axis to tumble said containers, thereby mixing the chemical solutions contained therein;

means for maintaining the containers substantially stationary relative to said tumbler during rotational movement thereof, whereby to prevent shifting of the containers in the tumbler;

an electric circuit activating said power means when completed and deactivating said power means when interrupted;

a timing switch in said circuit which is closed to effect completion of said circuit for a preselected time period and which opens following elapse of said time period;

a normally closed switch arranged in said circuit in parallel with said timing switch to normally maintain said circuit in a completed condition regardless of the state of the timing switch; and means for opening said normally closed switch each time said tumbler is oriented to orient said containers in upright positions, whereby said timing and normally closed switches are both open to interrupt said circuit only after said preselected time period has elapsed and said tumbler has reached an orientation to orient the containers in upright positions.

2. A machine as set forth in claim 1, wherein said opening means comprises a cam element carried on said tumbler and a switch actuator operated by said cam element in a manner to effect opening of said normally closed switch when said tumbler is oriented such that the containers are in upright positions.

3. A machine as set forth in claim 1, wherein:

said rack structure has opposite sides equipped with outwardly projecting handles; and said tumbler comprises a box member adapted to closely receive said rack structure therein, said box member having opposite sides with openings therein through which said handles project when the rack structure is inserted in said box member.

4. A machine as set forth in claim 1, wherein said maintaining means comprises:

a floor portion of said tumbler adapted to contact the bottom portions of the containers when said rack structure is inserted in the tumbler; and a lid portion of said tumbler having an open position wherein the rack structure may be inserted into said tumbler and a closed position wherein said lid portion contacts the top portions of the containers, whereby the containers are held closely between said floor and lid portions during rotational movement of the tumbler.

5. A machine as set forth in claim 4, wherein said floor portion of the tumbler is removable therefrom to permit replacement of said floor portion by additional floor portions which vary in thickness to accomodate containers of varying heights.

6. A machine as set forth in claim 4, including releasable means for latching said lid portion of the tumbler in the closed position thereof.

* * * * *